United States Patent [19]

Riollet et al.

[11] 4,362,465

[45] * Dec. 7, 1982

[54] SET OF BLADES FOR A TURBINE

[75] Inventors: Gilbert Riollet, Paris; Raymond Bessay, Belfort, both of France

[73] Assignee: Societe Anonyme Dite: Alsthom-Atlantique, Paris, France

[ * ] Notice: The portion of the term of this patent subsequent to Jun. 22, 1999, has been disclaimed.

[21] Appl. No.: 196,798

[22] PCT Filed: Oct. 4, 1979

[86] PCT No.: PCT/FR79/00090

§ 371 Date: Jun. 5, 1980

§ 102(e) Date: Jun. 2, 1980

[87] PCT Pub. No.: WO80/00729

PCT Pub. Date: Apr. 17, 1980

[30] Foreign Application Priority Data

Oct. 5, 1978 [FR] France ..... 78 28461

[51] Int. Cl.[3] ..... F02C 7/92

[52] U.S. Cl. ..... 415/144

[58] Field of Search ..... 415/144, 115, 168, DIG. 1

[56] References Cited

U.S. PATENT DOCUMENTS

| | | | |
|---|---|---|---|
| 2,291,828 | 8/1942 | New | 415/115 |
| 4,146,352 | 3/1979 | Yasugahira et al. | 415/144 |

FOREIGN PATENT DOCUMENTS

| | | |
|---|---|---|
| 876282 | 3/1953 | Fed. Rep. of Germany . |
| 1106027 | 5/1961 | Fed. Rep. of Germany . |
| 341014 | 7/1904 | France . |
| 833985 | 11/1938 | France . |

*Primary Examiner*—Robert E. Garrett

*Attorney, Agent, or Firm*—Sughrue, Mion, Zinn, Macpeak & Seas

[57] ABSTRACT

A set of blades for a turbine which includes a group of blades disposed between an upper plate (12) and a lower plate (11) which delimit a group of passages (3). Said set of blades includes ducts (13,14) provided in the upper plate (12) and/or in the lower plate (11), each duct opening at one end in the neighborhood of the convex surface of a blade and level with the constriction (6) of the passage and at the other end at a point situated upstream from said set of blades. Reduction of the low pressure on the convex surfaces only adjacent the upper plate (12) and the lower plate (11), reducing secondary losses, while pressure distribution remains optimum in the zone of good flow of the passage.

5 Claims, 3 Drawing Figures

SET OF BLADES FOR A TURBINE

FIELD OF THE INVENTION

The present invention relates to a set of blades for a turbine which includes a group of blades disposed between an upper plate and a lower plate. The group of blades therefore defines a group of passages along which a fluid flows, each passage being delimited by the convex surface of one blade and the concave surface of the blade next to it and by the lower plate and the upper plate.

BACKGROUND OF THE INVENTION

It is known that in a given passage, at points which are sufficiently far from the walls of the passage, the stream lines follow paths which are substantially parallel to the walls of the passage formed by the concave and convex surfaces of the blades. At all points along the path, the centrifugal force which is exerted on a particle is balanced by the pressure forces. The result of this is, generally, that the concave surface of the blade is subjected to a higher pressure than is the convex surface of the other blade which delimits the passage.

It is also known that in the boundary layer near the lower plate and upper plate, the speed of the fluid is low. It follows that the pressure forces are no longer balanced and the stream lines are curves perpendicular to the isobars and follow paths of considerable slippage in each passage from the concave surface to the convex surface as is well known to the person skilled in the art (see, for example, the article in the November 1941 French issue of the Brown Boveri review—p. 356 to 361 and, in particular FIGS. 2 and 3).

The slippage generates a counter-clockwise eddy against the upper plate of the passage and a clock-wise eddy against the lower plate as seen by an observer placed downstream from the set of blades.

These disturbances cause important losses known as secondary losses and the smaller the ratio between the height of the blades and the chord, the more the efficiency of a set of blades is reduced.

A known means for reducing the secondary losses consists in reducing the aerodynamic loading on the blades. This is equivalent to reducing the difference in average pressure between their concave and the convex surfaces e.g. by reducing the blade spacing to chord ratio of the set of blades.

However, the disadvantage of the above method is that it increases the friction losses in the zone of good flow along the passage in such a way that the gain obtained on the secondary losses can be cancelled by increasing the friction losses in the main flow.

SUMMARY OF THE INVENTION

The set of blades in accordance with the present invention which allows the secondary losses to be reduced without having any influence on the friction losses in the main flow is characterized in that for each blade, at least one duct is provided in the upper plate, said duct opening at one end in the neighbourhood of the convex surface of said blade and level with the constriction of the passage which is delimited by the convex surface of said blade and at the other end at a point situated upstream from said set of blades and/or at least one duct is provided in the lower plate and opens at one end in the neighbourhood of the convex surface of the blade and level with the constriction of the passage which is delimited by the convex surface of said blade and at the other end at a point situated upstream from said set of blades. The constriction of the passage is the place where the convex surface of one blade and the concave surface of the blade next to it are the nearest together, said blades delimiting said passage.

The point situated in the neighbourhood of the convex surface of the blade in the constriction of the passage is the point of the passage where the pressure is at its minimum. Due to the set of blades in accordance with the invention, the low pressure on the convex surface is reduced by a duct which leads to a higher-pressure chamber. This reduces the difference in average pressure between the convex surface and the concave surface. However, the reduction in pressure takes place in only a zone adjacent the lower plate and/or the upper plate of the passage, thus reducing the secondary losses, while the aerodynamic loading remains optimum in the portion of good flow along the passage. The reduction of the low pressure adjacent the convex surface reduces the slippage of the boundary layers and the losses due to secondary flow.

In the case where the set of blades does not include an upper plate (some moving blades) or a lower plate (some fixed blades), the passages are then formed only in the lower plate (moving blades) or in the upper plate (fixed blades).

The following description given with reference to the accompanying drawings will make it easier to understand how the invention can be implemented.

DESCRIPTION OF THE PRIOR ART AND THE PREFERRED EMBODIMENT

Figure 1:
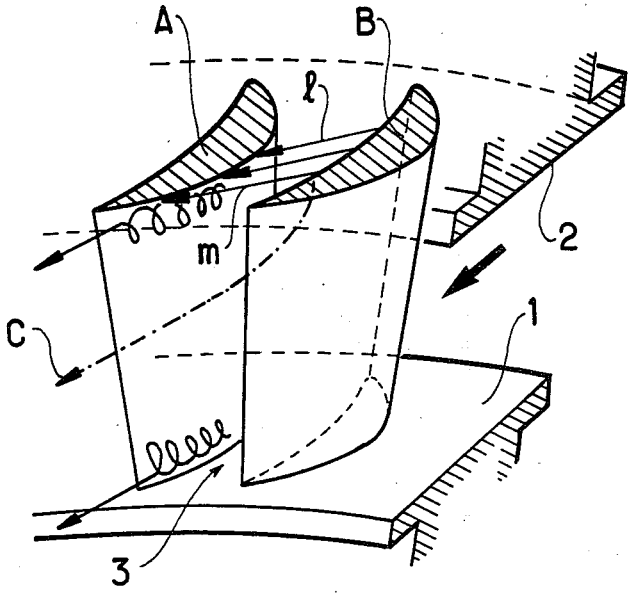
FIG.1 (PRIOR ART)
FIG. 1 is a perspective view which illustrates part of the set of blades of a conventional turbine.

FIG. 1 illustrates two blades A and B which form a part of a prior art turbine and whose roots are fixed to a lower plate 1 while their heads are fixed to an upper plate 2. The lower plate and the upper plate are usually cylindrical or frustoconical surfaces.

Figure 3:
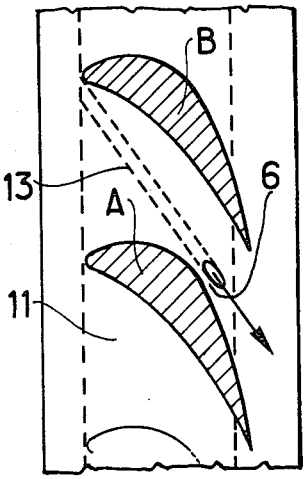
FIG. 3 is a transversal cross-section seen from above of a set of blades in accordance with the invention.

A passage 3 is delimited by the concave surface of the blade B, the convex surface of the blade A, the lower plate, and the upper plate. The passage 3 has a constriction 6 (see FIG. 3) which is the point where the convex surface of the blade A is nearest the concave surface of the blade B.

Fluid far from the walls of the passage flows smoothly along streamlines such as (c). In contrast, streamlines of fluid which come into contact with the upper plate and the lower plate are orthogonal to the isobars and flow in the directions shown (l) and (m), then begin to be turbulent as soon as they strike the convex surface of the blade (A).

Figure 2:
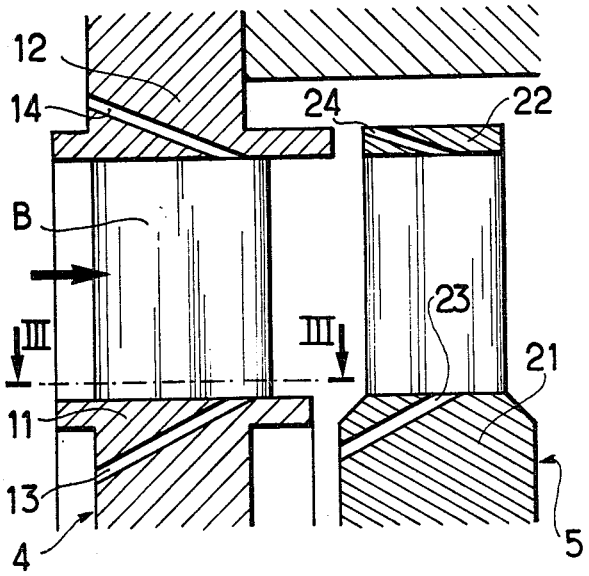
FIG. 2 is an axial cross-section of a turbine which includes sets of blades in accordance with the invention.

FIG. 2 illustrates an axial cross-section of a turbine fitted with sets of fixed blades 4 and moving blades 5 in accordance with the invention.

For each blade 4 of the set of fixed blades, a duct 13 is provided in the lower plate 11 between a point in the neighbourhood of the concave surface of the blade and opening to the constriction 6 of the passage, said point being the point where the pressure along the convex surace is at its minimum, and a point upstream from the set 4 of blades (see FIG. 3) in a zone where the pressure is high.

Also for each blade 4 of the set of fixed blades, a duct 14 is provided in the upper plate 12 between a point in the neighbourhood of the convex surface of the blade and opening to the constriction 6 of the passage, and a point upstream from said set of blades in a zone where the pressure is high.

For each blade 5 of the set of moving blades, a duct 24 is provided in the upper plate 22. Said duct begins at a point in the neighbourhood of the convex surface of the blade and opening to the constriction 6 of the passage (minimum pressure point) and ends upstream from said set of blades 5 (high-pressure zone).

Also, for each blade 5 of the set of moving blades, a duct 23 is provided in the lower plate 21. Said duct begins at a point in the neighbourhood of the convex surface of the blade and opens to the constriction 6 of the passage (minimum pressure point) and ends upstream from the set of blades 5 (high-pressure zone).

The passages between a point of the lower plate and/or of the upper plate at the minimum pressure points of the convex surfaces of the blades and a point in a high-pressure chamber constituted by the portion situated upstream from the blades make it possible to reduce the low pressure in the neighbourhood of the convex surfaces of the blades and level with the lower plate and/or with the upper plate.

It is self-evident that the turbine in accordance the the invention could be provided with such ducts only on the sets of moving blades or on the sets of fixed blades in the lower plate and/or upper plate of these sets of blades.

Further, these ducts could be associated with only some blades of the same set.

We claim:

1. In a set of blades for a turbine, said set of blades including a group of blades bearing opposite convex and concave surfaces disposed between an upper plate and a lower plate which delimite a group of passages, the improvement wherein, for each blade, said set includes at least two ducts (13, 14), one in the upper plate (12) and the other in the lower plate (11), each duct (13, 14) opening at one end in the neighbourhood of the convex surface of the blade and at the constriction (6) of the passage which is delimited by the convex surface of said blade and, in the other end, at a point situated upstream from said set of blades.

2. In a set of blades for a turbine, said set of blades including a group of blades having opposite convex and concave surfaces disposed between an upper plate and a lower plate which delimit a group of passages, the improvement wherein, said set includes ducts in the upper plate (12) which are associated with the blades (14), each duct opening at one end in the neighbourhood of the concave surface of the blade at the constriction (6) of the passage which is delimited by the convex surface of said blade and, at the other end, at a point situated upstream from said set of blades.

3. In a set of blades for a turbine, said set of blades including a group of blades having opposite concave and convex surfaces disposed between an upper plate and a lower plate which delimit a group of passages, the improvement wherein, said set includes ducts in the lower plate (11) which are associated with the blades (13), each duct opening at one end in the neighbourhood of the convex surface of the blade at the constriction (6) of the passage which is delimited by the convex surface of said blade and, at the other end, at a point situated upstream from said set of blades.

4. In a set of moving blades for a turbine, said set of moving blades including a group of blades having opposite concave and convex surfaces assembled on a lower plate which delimit a group of passages, the improvement wherein, said set includes ducts in the lower plate (21) which are associated with the blades, each duct opening at one end in the neighbourhood of the convex surface of the blade at the constriction of the passage which is delimited by the convex surface of said blade and, from the other end, at a point situated upstream from said set of blades.

5. In a set of fixed blades for a turbine, said fixed blades including a group of blades having opposite concave and convex surfaces assembled on an upper plate which delimit a group of passages, the improvement wherein, said set includes ducts in said upper plate (12) which are associated with the blades, each duct opening at one end in the neighbourhood of the convex surface of the blade at the constriction of the passage which is delimited by the convex surface of said blade and, at the other end, at a point situated upstream from said set of blades.

* * * * *